United States Patent [19]

Kupchunos

[11] Patent Number: 4,986,329

[45] Date of Patent: Jan. 22, 1991

[54] WINDOW COVERING ASSEMBLY WITH DISCRETE POSITIONING FEATURE AND METHOD OF USE

[76] Inventor: Mary L. Kupchunos, 392 Felt Rd., South Windsor, Conn. 06074

[21] Appl. No.: 479,834

[22] Filed: Feb. 14, 1990

[51] Int. Cl.[5] ..... E06B 9/06

[52] U.S. Cl. ..... 160/84.1; 160/330; 160/387

[58] Field of Search ..... 160/84.1, 330, 348, 160/350, 387; 248/262, 263

[56] References Cited

U.S. PATENT DOCUMENTS

| | | | |
|---|---|---|---|
| 736,242 | 8/1903 | Gable . | |
| 762,733 | 6/1904 | Malmquist | 248/263 |
| 928,190 | 7/1909 | Flynn | 160/330 |
| 1,216,271 | 2/1917 | Behl | 160/330 X |
| 1,498,594 | 6/1924 | Watson . | |
| 1,916,835 | 7/1933 | Goldstein | 248/263 |
| 2,178,437 | 10/1939 | Schonfarber . | |
| 2,246,663 | 6/1941 | Bradshaw . | |
| 2,528,652 | 7/1950 | Gundlach . | |
| 3,913,655 | 10/1975 | Ogino . | |
| 4,221,256 | 9/1980 | Karaki . | |
| 4,249,589 | 2/1981 | Loeb . | |
| 4,802,523 | 2/1989 | Scholten et al. . | |
| 4,836,265 | 6/1989 | Bussert . | |

*Primary Examiner*—Blair M. Johnson

*Attorney, Agent, or Firm*—McCormick, Paulding & Huber

[57] ABSTRACT

A window covering assembly comprises a window covering formed from limp sheet material and has a plurality of horizontally extending pockets each receiving a dowel therein. The first and the second brackets are spaced apart from one another a distance less than the length of each dowel such that portions of each of the first and second brackets are capable of supporting the opposite ends of each dowel therein. The window covering hangs in a fully lowered condition when the dowel extending through the upper pocket is solely supported on the brackets. Alternatively, the covering may be oriented at a half valance condition when either of the remaining two dowels is supported on the brackets along with the upper end dowel. The covering may also be held in a fully open condition when all three of the dowels are supported on the brackets.

21 Claims, 7 Drawing Sheets

WINDOW COVERING ASSEMBLY WITH DISCRETE POSITIONING FEATURE AND METHOD OF USE

BACKGROUND OF THE INVENTION

This invention relates to a window covering for providing security against unwanted viewing into a room of a home or office and for blocking out bright sunlight therein and more particularly relates to an improved window covering assembly with particular aesthetic characteristics capable of being easily manufactured and installed onto existing window structure and having means by which the covering may be selectively positioned at different valances to limit the amount of window area being covered.

Hitherto, the use of shades for providing security against unwanted viewing through a window and into an enclosed environment, such as a room in a home or office, has been generally well known. With such shades, the covering material is usually wound around a roller rotatably supported between opposite sides of the window frame proximate its upper end. Often, each shade must be custom fit so as to be secured precisely within the width of its associated window frame and therefore cannot be readily usable in different rooms or buildings, such as in the case where a person moves or temporarily resides in a vacation house. Also, since variable positioning of the covering material in these shades is accomplished mechanically, this mechanism often becomes inoperative with repeated use and thereafter must be replaced. Furthermore, these shades have little decorative value and typically must be covered with curtains to give the room a warm livable look. Such curtains usually hang from a complex system of tracks along which runners connecting the curtain or drape to the tracks move. Also, the tracks are usually located above both the window and the shade to allow the drape or curtain material to be pleated lengthwise to give it an enhanced decorative look. However, it has been found by homekeepers that these curtains or drape coverings require of the homekeeper much care and attention. Also, like the roller type shades, these drape or curtain assemblies are not easily portable and do not lend themselves to ready assembly or disassembly, such as for seasonal use in a beach house or the like. Lately, the MINIBLIND has found increased use for covering windows in interior environments as well. However, cleaning of the individual blind elements is for some people too time consuming and delicate of a task.

Accordingly, it is an object of the present invention to provide an easily installable portable window covering assembly which may be mounted onto a wall adjacent a window or to the window frame itself and which covering assembly being readily formed from inexpensive materials and assembled for use with relative ease.

It is yet another object of the present invention to provide a window covering assembly for a window which is capable of blocking out bright sunlight as well as protecting the privacy of a home or office and which window covering assembly being decorative in form so as not to require the use of curtains or draperies to add aesthetically to it.

It is yet a further object of the present invention to provide a window covering assembly of the foregoing type having means by which the covering may be selectively raised and lowered between different vertical heights without need of moving parts.

Further objects and advantages of the invention will be apparent from the following description and the drawings and from the appended claims.

SUMMARY OF THE INVENTION

The present invention resides in a window covering assembly capable of being readily attached to structure adjacent a window to be covered and is comprised of two parallel spaced apart brackets mounted above the window and a window covering formed from generally limp material having a series of vertically spaced apart pockets formed transversely through it. Received within each of the pockets is a rod which extends through the covering material such that each of the rods has end portions projecting laterally outwardly of the window covering material. The projecting portions of each rod is received within one of a series of juxtaposed spaces formed on each of the brackets for supporting one or all of the rods thereon.

The window covering material has on pocket formed at its upper end and one at its lower end and at least a third at an intermediate location therebetween. As such, the orientation of these pockets permits the covering material to hang in a fully closed condition when the rod extending through the upper pocket is solely supported on the brackets and, alternatively, allowing the covering material to be oriented at a half valance when either of the remaining two rods is supported on the brackets along with the upper end rod. The window covering material is thus held in a fully open condition when all of the rods are supported on the brackets.

The window covering material) may be comprised of two sheets of fabric each of which may be of the same color and/or design or may be differently colored or one of which may be a solid design and the other being a printed pattern such that when the rods are held upwardly by the brackets, the ply of fabric which otherwise would have been directed away from viewing is subsequently exposed.

DETAILED DESCRIPTION OF THE PREFERRED EMBODIMENTS

Figure 1:
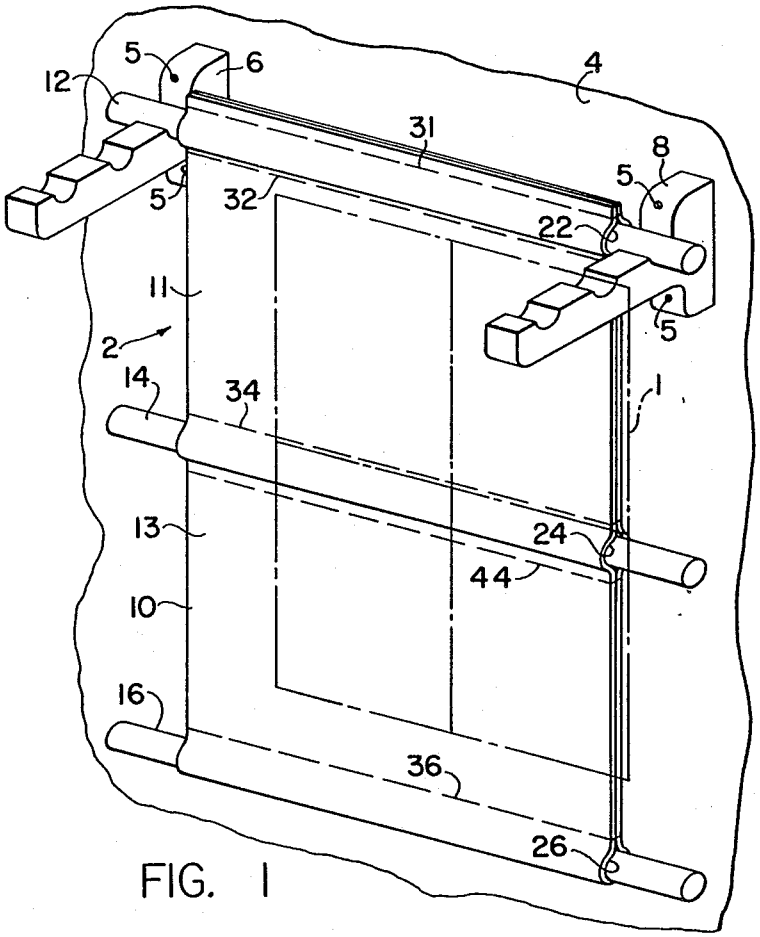
FIG. 1 is a perspective view showing the window covering assembly of the present invention in its fully lowered condition as attached to the wall structure adjacent a window to be covered.

In FIG. 1, a window covering assembly 2 embodying the present invention is shown connected to an interior wall 4 of a house or other enclosed structure and is typically positioned adjacent a window 1 formed in the wall. The window covering assembly 2 includes a covering material 10, rods 12, 14 and 16 transversely extending through the covering material 10 and a first bracket 6 and a second bracket 8 which hold one or all the rods in position above the window 1. The window covering assembly 2 as shown in FIG. 1 employs three rods but may be easily modified to receive more rods if so desired.

Figure 2:
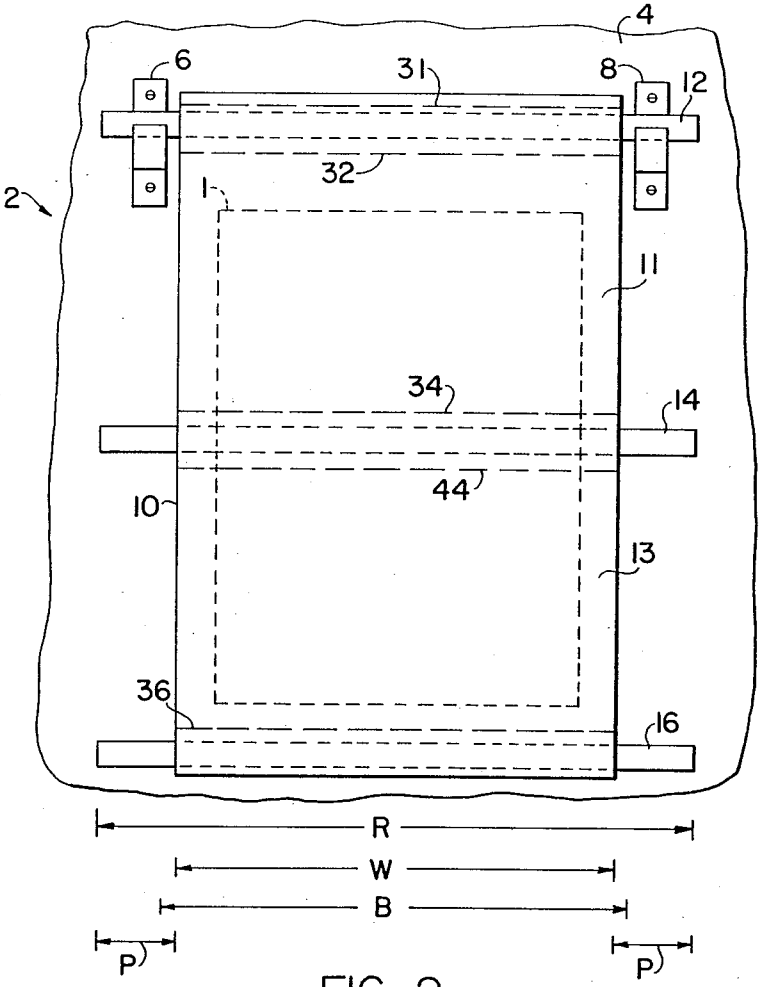
FIG. 2 is a front elevation view of the window covering assembly of FIG. 1.

As can be readily appreciated from FIGS. 1 and 2, the covering material 10 is preferably sized such that its length L and width W sufficiently extend beyond the frame of the window 1 when the covering assembly is in its fully lowered condition. The covering material 10 is limp in its relaxed state and so is capable of being easily folded upon itself but is nevertheless sufficiently strong in tension to create substantially flat upper and lower portions 11 and 13, respectively, when in its fully lowered condition. The covering material 10 is preferably a cotton fabric on the order of 2 to 3 mils thick and may be provided in a variety of solid colors or with any suitable design or pattern or shade of print as will hereinafter be discussed with reference to the reversible decorative feature of the assembly.

To selectively attach the covering material 10 to each of the brackets 6 and 8, the covering material 10 has three pockets 22, 24 and 26 each extending transversely of the material length dimension L for receiving one of the rods 12, 14 and 16 therein. The pockets are spaced apart from one another by the upper portion 11 and the lower portion 13 of the covering material 10 such that the pocket 22 is adjoined the covering material upper end and the pocket 26 is adjoined the covering material lower end with the pocket 24 being disposed intermediately therebetween.

As is apparent from FIG. 2, the spatial relationships between the component parts of the window covering assembly 2 enable it to be readily oriented at various desired valances. To this end, each of the rods 12, 14 and 16 has a length dimension R which is larger than the width dimension W of the covering material 10 such that the end portions of the rods 12, 14 and 16 project outwardly of and beyond the covering material 10 a distance indicated by the dimension P. Since the brackets 6 and 8 are spaced apart from one another on the wall 4 by a distance indicated as dimension B, which distance being less than the length R of the rods but greater than the width W of the window covering 10, the brackets 6 and 8 thus provide an underlying support for the projecting end portions of the rods while nevertheless receiving the window covering material therebetween.

Figure 3:
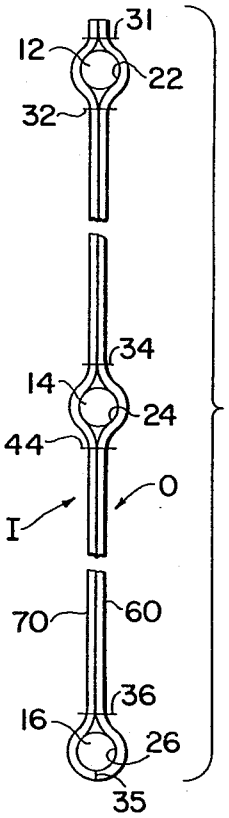
FIG. 3 is a side elevation view of the preferred embodiment of the window covering material.

In FIG. 3, the configuration of the preferred embodiment of the covering material 10 is shown in detail. The covering material 10 may be comprised of two sheets of material 60 and 70 sewn together to form a unitary piece having a face O outwardly directed towards the window 1 and an oppositely directed face I. In the illustrative example, the sheets 60 and 70 are first sewn together along one end at 35 and are then folded so that the seam 35 is outwardly exposed and located midway between the two sheets. The lower end pocket 26 is thus formed by stitching the sheets 60 and 70 together along line 36 spaced from the seam 35 by an amount slightly greater than the diameter of the rod 16. The intermediate pocket 24 may be readily formed by stitching the two sheets 60 and 70 together along lines 34 and 44 spaced from each other slightly more than the diameter of the rod 14, thus creating the hems which define the intermediate pocket 24. Finally, the upper end pocket 22 is formed by stitching the sheets 60 and 70 along each end at 31 and along a lower line 32 spaced from the end line 31 slightly more than the diameter of rod 12. As such, each of the pockets loosely receives a rod, which in the preferred embodiment have a diameter of approximately a half inch. The rods 12, 14 and 16 may take the form of any elongate member, but in the preferred embodiment of the invention, wooden or plastic dowels are used for this purpose.

Figure 4:
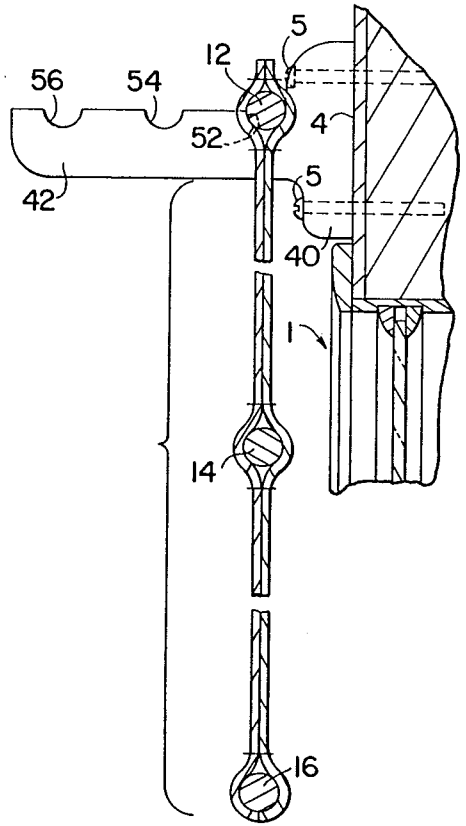
FIG. 4 is a sectional view taken vertically through the covering material looking to the left in FIG. 2 and showing the assembly in a fully lowered condition.

Referring now to FIG. 4 for a detailed description of the brackets 6 and 8 and the manner in which they are configured for supporting the rods which extend through the covering material 10, it will be seen that the brackets 6 and 8 are generally identical elements each fixably connected to the wall 4 by anchor screws 5, 5 or the like. The brackets 6 and 8 each have a generally vertical portion 40 through which portion at each upper and lower end thereof are received the screws 5, 5 for securing the brackets to the wall. Each vertical portion 40, 40 is integrally connected with a horizontal portion 42 such that the horizontal portions of the brackets 6 and 8 are cantilevered outwardly of the wall 4 which supports it.

For removeably supporting the respective end portions of the rods 12, 14 and 16 on the brackets 6 and 8, a series of juxtaposed spaces identified as 52, 54 and 56 are formed in each horizontally extending portion 42, 42 of the brackets 6 and 8. The spaces preferably are generally U-shaped and are slightly larger across than the diameter of the rods received by them. Also, the spaces 52, 54 and 56 are equally separated from one another by the indicated distance S such that the spaces on one bracket are each laterally aligned with a corresponding ordered one of the spaces formed in the other opposite bracket. This results in the rods 12, 14 and 16 each being held in a parallel relationship with one another when supported by the brackets 6 and 8.

In use, the window covering assembly 2 has a first mode of operation as shown in FIGS. 1 and 2 in which the covering material 10 extends vertically downwardly of the brackets 6 and 8 and parallel to the wall 4, and in which mode the covering material is supported solely by the upper end rod 12 on the brackets 6 and 8 to define a fully lowered condition. In this mode, both the upper portion 11 and the lower portion 13 of the covering material 10 are maintained in tension thus giving the covering material 10 a generally planar outwardly appearance.

Figure 5:
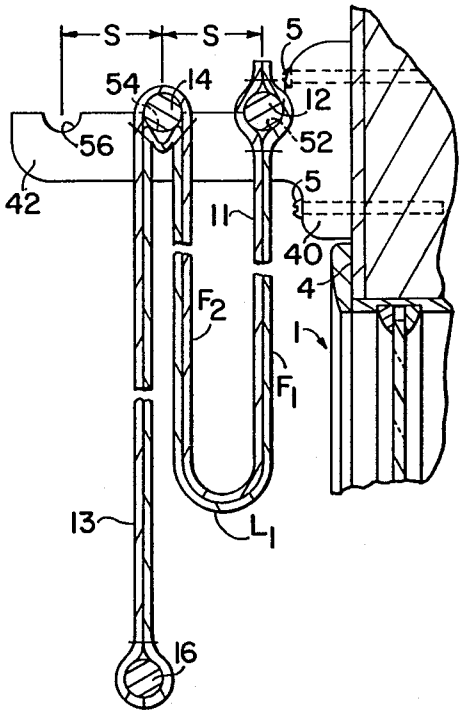
FIG. 5 is a sectional view taken vertically through the covering material looking to the left in FIG. 2 and shows a first way in which a half valance condition may be created in the window covering assembly.

In a second mode of operation, the window covering material 10 as shown in FIG. 5, may be placed in a half valance condition by moving the intermediate rod 14 upwardly around the brackets 6 and 8 and into one of the remaining pairs of spaces 54, 54 and 56, 56. This results in the upper portion 11 of the covering material 10 being divided into folds $F_1$ and $F_2$ with connecting loop $L_1$ of these folds being oriented substantially higher than the lower end of the covering material 10. As a result, the folds $F_1$ and $F_2$ are generally not apparent to a viewer within the room looking through the window 1.

Figure 6:
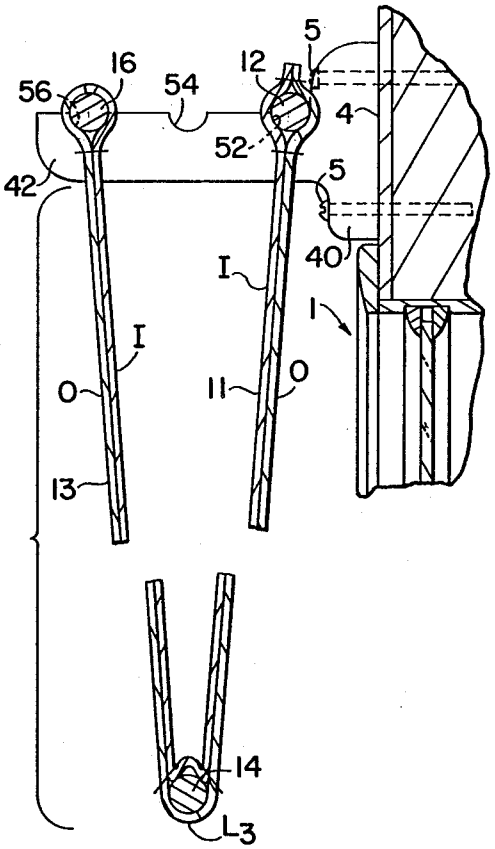
FIG. 6 is a sectional view taken vertically through the covering material looking to the left in FIG. 2 and shows a second way in which a half valance condition may be created in the window covering assembly.

As is apparent from FIG. 6, the half valance condition of the window covering assembly 2 may alternatively be accomplished by moving the lowermost rod 16 upwardly around the brackets 6 and 8 and into one of the remaining pairs of spaces 54, 54 and 56, 56. This results in the upper portion 11 and the lower portion 13 of the covering material 10 each becoming a fold connected at a single loop $L_3$. It should be appreciated that in this mode, the outwardly directed face O of the covering material 10 will now define the outer surface of both folds, thus enabling the color or pattern provided on face O to be exposed to the room environment while in turn concealing the color or pattern provided on face I which may, if so desired, be different from that of face O.

Figure 7:
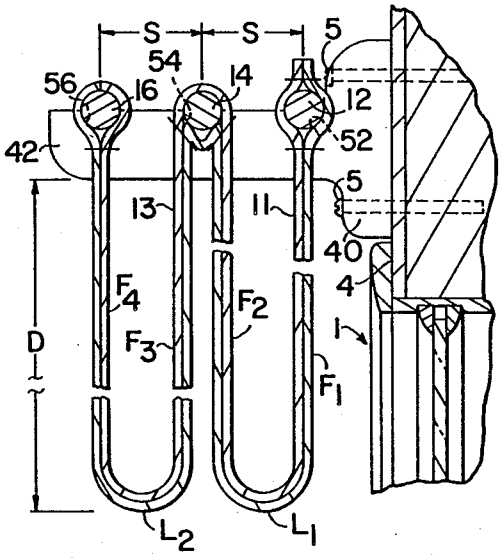
FIG. 7 is a sectional view taken vertically through the covering material looking to the left in FIG. 2 showing the window covering assembly in a fully raised condition.

In a third mode, the window covering assembly 2 as illustrated in FIG. 7 is capable of being oriented in its raised condition when each of the rods 12, 14 and 16 are respectively placed within the three pairs of spaces 52, 52, 54, 54 and 56, 56 provided by the brackets 6 and 8. In this mode, the upper portion 11 of the covering material 10 is divided into folds $F_1$ and $F_2$ joined by the loop portion $L_1$ and the lower portion 13 of the covering material 10 is divided into two parallel spaced apart folds $F_3$ and $F_4$ joined at each lower end by a second loop $L_2$. It should then be appreciated that in the fully raised condition of the assembly, loops $L_1$ and $L_2$ are each held at a fixed distance D below the brackets 6 and 8 such that only small portions of the folds $F_1$, $F_2$, $F_3$ and $F_4$ usually on the order of one fourth the length of the covering material 10 remain covering the window 1.

Further from FIG. 7, it should be seen that the dimension S is such that when all three rods are supported by the brackets 6 and 8, the folds formed in the covering material 10 are uniformly separated from one another thus further adding to the aesthetic characteristics of the window covering assembly 2. Also, it is a further feature of this mode, that the outer face O of the covering material 10 becomes exposed to the interior environment when all three rods 12, 14 and 16 are held in position by the brackets 6 and 8 thereby enabling the pattern or color provided on the outer face O to be seen.

By the foregoing, a window covering assembly capable of being readily, versatilely mounted to any variety of window shapes or sizes is disclosed in the present invention. However, numerous modifications and substitutions may be had without departing from the spirit of the invention. For example, while the covering material 10 has been disclosed in the preferred embodiment as a two-ply element, it is entirely within the scope of the invention to utilize a single ply piece of material folded along each side to provide finished edges and having a patch midway to its length for receiving the intermediate rod therein. Also, while the brackets 6 and 8 have been shown formed with the generally U-shaped spaces 52, 54 and 56 for receiving the rods 12, 14 and 16 respectively therein, it is likewise possible to form these brackets without any areas being removed, but instead simply create spaces on the brackets by fixing vertically extending elements, such as pins, into them between which the rods may be received. In the preferred embodiment, the window covering assembly 2 is disclosed as being capable of oriented in three different conditions, that is, the raised, lowered and partially opened condition. However, it is well within the scope of the present invention to employ additional rods and pockets in excess of the three provided in order to create additional valances conditions in the window covering assembly. Accordingly, the invention has been described by way of illustration rather than limitation.

What is claimed is:

1. Window covering assembly comprising:

a first bracket and a second bracket each being separately positionable in a spaced apart relationship relative to one another on a support surface;

a covering formed from limp sheet material and being vertically positionable at different heights relative to said first and said second brackets;

said covering having at least two substantially transversely extending pockets formed therein;

a plurality of rods each respectively received within one of said pockets formed in said covering, with each of said rods having opposite end portions projecting outwardly laterally beyond said covering;

said first and said second brackets each having corresponding discrete spaces thereon sized for receiving an end portion of one of said plurality of rods therein; and wherein said covering is vertically supported by said first and said second brackets when said opposite end portions of at least one of said plurality of rods are received within a corresponding space in each of said first and second brackets.

2. A window covering assembly as defined in claim 1 further characterized in that said covering has a first pocket oriented adjoined its upper end, a second pocket oriented adjoined its lower end and a third pocket located intermediately therebetween; and wherein each of said first, second and third pockets extend transversely across said covering and being oriented in a parallel relationship with one another.

3. A window covering assembly as defined in claim 2 further characterized in that said covering is comprised of two pieces of limp sheet material attached together with one another in a face to face relationship; and wherein said intermediate pocket is formed from portions of each of said two pieces of sheet material attached together along two parallel spaced apart lines in said covering.

4. A window covering assembly as defined in claim 1 further characterized in that each of said first and said second brackets has a horizontal portion integrally connected with a vertical portion;

each of said horizontal portions having a generally U-shaped cut-out formed therein; and said U-shaped cut-outs in each of said first and said second brackets being aligned with one another such that when said rods are received within respective ones of said cutouts, the rods are held in a parallel spatial relationship with one another.

5. A window covering assembly as defined in claim 4 further characterized in that each of said vertical portions include mounting means for fixing each of said brackets to said support surface.

6. A window covering assembly as defined in claim 5 further characterized in that said mounting means includes through openings formed in each of said vertical portions of each of said first and said second brackets; and wherein said mounting means further includes a mounting member received within each of said openings formed in said vertical portions of said first and said second brackets.

7. A window covering assembly as defined in claim 6 further characterized in that each of said first and said second brackets are spaced apart from one another at a first given distance; and wherein each of said rods received within said pockets of said covering being longer in length than said first given distance so that said end portions of each of said rods are received within associated ones of said generally U-shaped cutouts in each of said first and second brackets.

8. A window covering assembly as defined in claim 1 further characterized in that each of said rods is a wooden dowel having a diameter of approximately one-half inch; and wherein said material forming said covering being a cotton fabric.

9. A window covering assembly as defined in claim 2 further characterized by said covering being formed from a two-ply material and being capable of being oriented in a half valance condition when the dowel associated with one of said lower end or intermediate pockets is supported by each of said first and said second brackets along with the dowel associated with said upper end pocket.

10. A window covering assembly as defined in claim 2 further characterized in that said covering is a two-ply piece being formed from two limp sheets of material each of which sheet having a different color or pattern; and wherein said pockets receiving said rods are formed by hems sewn between said two pieces of limp material.

11. A window covering assembly as defined in claim 1 further characterized in that said covering is formed from row sheets of limp material;

one of said two generally transversely extending pockets being formed by a seam along each end of said two sheets of limp material which seam being oriented outwardly thereof, said first and second sheets of material being stitched together along a first line above said seam to form said one pocket; and wherein the other of said two generally transversely extending pockets being formed by the opposite ends of each of said first and second sheets of material and being stitched together along a second line and along a third line spaced downwardly of said second line to form said other pocket.

12. A window covering assembly as defined in claim 11 further characterized in that a third pocket is formed in said covering between said pockets at each end thereof; and said third pocket being formed by stitchings extending along two parallel spaced apart lines on each of said first and second sheets.

13. A method of varying the valance of a window covering assembly comprised by the steps of:

providing a first and second support member;

positioning said first and said second support members generally adjacent the top of a window and spacing each of said support members from one another;

providing a covering formed from generally limp material and having at least two pairs of projections each of which pairs being disposed at different vertical levels along the length of the covering with said different vertical levels being disposed at least at the upper and lower ends of said covering;

attaching said pair of projections located at said upper end of said cover to said first and second support members to allow said covering to hang downwardly from said first and said second support members; and selectively changing the valance of said covering by moving said other of said pairs of projections upwardly to be supported by said first and second support members thereby creating two folds in said covering material.

14. A method as defined in claim 13 further comprising the steps of providing three pairs of projections the third of which pair being disposed intermediately of said pairs of projections located at said covering upper and lower ends; and moving said intermediate pair of projections upwardly and into holding arrangement with said first and second support members to define a half valance condition wherein a first portion of said covering has first and second folds and the remaining portion of said covering extends vertically downwardly from said first and second support members.

15. A method as defined in claim 14 further characterized by moving said pair of projections associated with the lower end of said covering upwardly into holding engagement with each of said first and second support members thereby forming a third and a fourth fold in said remaining portion of said covering to create a fully open condition.

16. A method as defined in claim 13 further comprising the steps of providing three pairs of projections the third of which pair being disposed intermediately of said pairs of projections located at said covering upper and lower ends; and moving the pair of projections associated with the lower end of the covering upwardly into engagement with said first and second support members to create a half valance condition in said covering.

17. A method as defined in claim 15 further characterized by providing a covering formed from a first ply and a second ply of material:

said first ply of material being oriented outwardly toward a window and said second ply being oriented inwardly and being exposed to an interior environment when said covering is in its fully lowered condition; and wherein said first, second, third and fourth folds expose said first ply of material when said covering is in said fully open position.

18. A method as defined in claim 16 further characterized by said covering being formed from two plies of material with a first ply being oriented outwardly toward a window to be covered and said second ply being oriented inwardly thereof;

said first ply becoming inwardly exposed when said pair of projections associated with said cover lower end is moved upwardly into holding engagement with said first and second support members.

19. A method as defined in claim 18 further characterized by providing each of said first and second plies of material with a different color or pattern.

20. A method as defined in claim 17 further characterized by providing each of said first and second plies of material with a different color or pattern.

21. A shade assembly comprising:

a covering formed from limp sheet material having a given area defined by a given length and a given width;

mounting means for supporting said covering in a selected one of a plurality of depending positions to vary the effective area of said covering;

support means carried by said covering for cooperating with said mounting means to vary the effective length of said covering by selective engagement with said mounting means;

said support means including a plurality of elongate members each being removably carried by said covering;

each of said elongate members having a length greater than said covering given width such that the opposite ends of each one of said plurality of elongate members form rigid projecting members extending in pairs and in opposite directions from said covering at different vertical positions therealong; and said mounting means including a pair of transversely spaced apart brackets having means for receiving and releasably retaining associated pairs of rigid projecting members to selectively vary the effective area of said covering.

* * * * *